US010400313B2

(12) United States Patent
Sigli et al.

(10) Patent No.: US 10,400,313 B2
(45) Date of Patent: Sep. 3, 2019

(54) METHOD FOR TRANSFORMING AL—CU—LI ALLOY SHEETS IMPROVING FORMABILITY AND CORROSION RESISTANCE

(71) Applicant: CONSTELLIUM ISSOIRE, Issoire (FR)

(72) Inventors: Christophe Sigli, Grenoble (FR); Bernard Bes, Seyssins (FR); Frank Eberl, Issoire (FR)

(73) Assignee: CONSTELLIUM ISSOIRE, Issoire (FR)

( * ) Notice: Subject to any disclaimer, the term of this patent is extended or adjusted under 35 U.S.C. 154(b) by 886 days.

(21) Appl. No.: 14/783,449

(22) PCT Filed: Apr. 7, 2014

(86) PCT No.: PCT/FR2014/000076

§ 371 (c)(1),
(2) Date: Oct. 9, 2015

(87) PCT Pub. No.: WO2014/167191

PCT Pub. Date: Oct. 16, 2014

(65) Prior Publication Data

US 2016/0304995 A1 Oct. 20, 2016

(30) Foreign Application Priority Data

Apr. 12, 2013 (FR) ..... 13 00870

(51) Int. Cl.

| | |
|---|---|
| ***C22C 21/18*** | (2006.01) |
| ***C22C 21/12*** | (2006.01) |
| ***C22C 21/16*** | (2006.01) |
| ***C22F 1/057*** | (2006.01) |
| ***B22D 7/00*** | (2006.01) |
| ***C22C 21/14*** | (2006.01) |

(52) U.S. Cl.

CPC ..... *C22C 21/18* (2013.01); *B22D 7/005* (2013.01); *C22C 21/12* (2013.01); *C22C 21/14* (2013.01); *C22C 21/16* (2013.01); *C22F 1/057* (2013.01)

(58) Field of Classification Search

CPC ..... C22C 21/12

See application file for complete search history.

(56) References Cited

U.S. PATENT DOCUMENTS

| | | | |
|---|---|---|---|
| 5,032,359 | A | 7/1991 | Pickens et al. |
| 5,455,003 | A | 10/1995 | Pickens et al. |
| 7,229,509 | B2 | 6/2007 | Cho |
| 7,438,772 | B2 | 10/2008 | Rioja et al. |
| 2004/0071586 | A1 | 4/2004 | Rioja et al. |
| 2009/0142222 | A1 | 6/2009 | Colvin et al. |

FOREIGN PATENT DOCUMENTS

| | | | |
|---|---|---|---|
| EP | 1045043 | A1 | 10/2000 |
| EP | 1891247 | A1 | 2/2008 |
| EP | 1966402 | A1 | 9/2008 |
| WO | 2006131627 | A1 | 12/2006 |
| WO | 2007080267 | A1 | 7/2007 |

OTHER PUBLICATIONS

English machine translation of WO 2006/131627 A1 of Bes et al. (Year: 2006).*

International Search Report from corresponding PCT/FR2014/000076, dated May 30, 2014.

* cited by examiner

*Primary Examiner* — Jessee R Roe
*Assistant Examiner* — Jophy S. Koshy
(74) *Attorney, Agent, or Firm* — McBee Moore Woodward & Vanik IP, LLC

(57) ABSTRACT

A method for producing a rolled product 0.5 to 10 mm thick made from an aluminum alloy comprising, in particular, copper and lithium, in which, after solution annealing and quenching, a short heat treatment is carried out in which the sheet reaches a temperature of between 145° C. and 175° C. for 0.1 to 45 minutes, the speed of heating being between 3 and 600° C./min. The sheet obtained at the end of the method according to the invention has high corrosion resistance and is capable of being shaped for producing a structural element for an aircraft, in particular an aircraft fuselage skin.

17 Claims, 2 Drawing Sheets

METHOD FOR TRANSFORMING AL—CU—LI ALLOY SHEETS IMPROVING FORMABILITY AND CORROSION RESISTANCE

CROSS REFERENCE TO RELATED APPLICATIONS

This application is a § 371 National Stage Application of PCT/FR2014/000076, filed 7 Apr. 2014, which claims priority to FR 13/00870.

BACKGROUND

Field of the Invention

The invention relates to aluminium-copper-lithium alloy products, more particularly, such products, the methods of manufacture and use thereof, intended in particular for aeronautical and aerospace construction.

Description of Related Art

Rolled products made of aluminium alloy are developed in order to produce highly resistant parts intended in particular for the aeronautics industry and the aerospace industry.

Aluminium alloys containing lithium are very interesting in this respect, as lithium can reduce the density of the aluminium by 3% and increase the modulus of elasticity by 6% for each percent by weight of lithium added.

U.S. Pat. No. 5,032,359 describes a vast family of aluminium-copper-lithium alloys in which the adding of magnesium and silver, in particular between 0.3 and 0.5 percent by weight, makes it possible to increase the mechanical resistance.

U.S. Pat. No. 5,455,003 describes a method for manufacturing AI—Cu—Li alloys that have improved mechanical resistance and tenacity at a cryogenic temperature, in particular thanks to suitable strain-hardening and heat treatment. This patent recommends in particular the composition, as a percentage by weight, Cu=3.0-4.5, Li=0.7-1.1, Ag=0-0.6, Mg=0.3-0.6 and Zn=0-0.75.

U.S. Pat. No. 7,438,772 describes alloys comprising, as a percentage by weight, Cu: 3-5, Mg: 0.5-2, Li: 0.01-0.9.

U.S. Pat. No. 7,229,509 describes an alloy comprising (% by weight): (2.5-5.5) Cu, (0.1-2.5) Li, (0.2-1.0) Mg, (0.2-0.8) Ag, (0.2-0.8) Mn, 0.4 max Zr or other agents that refine the grain such as Cr, Ti, Hf, Sc, V.

U.S. Patent application 2009/142222 A1 describes alloys comprising (as a % by weight), 3.4 to 4.2% of Cu, 0.9 to 1.4% of Li, 0.3 to 0.7% of Ag, 0.1 to 0.6% of Mg, 0.2 to 0.8% of Zn, 0.1 to 0.6% of Mn and 0.01 to 0.6% of at least one element for controlling the granular structure. This application also describes a method for manufacturing extruded products.

Patent EP 1,966,402 describes an alloy that does not contain zirconium intended for fuselage sheets of an essentially recrystallised structure comprising (as a % by weight) (2.1-2.8) Cu, (1.1-1.7) Li, (0.2-0.6) Mg, (0.1-0.8) Ag, (0.2-0.6) Mn. The products obtain in the T8 temper are not capable of being substantially shaped, with in particular an $R_m/R_{p02}$ ratio less than 1.2 in the directions L and LT.

Patent EP 1,891,247 describes an alloy intended for fuselage sheets comprising (as a % by weight) (3.0-3.4) Cu, (0.8-1.2) Li, (0.2-0.6) Mg, (0.2-0.5) Ag and at least one element from among Zr, Mn, Cr, Sc, Hf and Ti, wherein the contents in Cu and in Li satisfy the condition Cu+5/3 Li<5.2. The products obtained in the T8 temper are not capable of being substantially shaped, with in particular an $R_m/R_{p02}$ ratio less than 1.2 in the directions L and LT. It was in addition observed that the total energy at rupture measured by the Kahn test which is linked to tenacity decreases with deformation and more brutally for a deformation of 6%, which poses the problem of obtaining a high tenacity regardless of the rate of local deformation during shaping.

Patent EP 1045043 describes the method of manufacturing parts formed from an alloy of the type AA2024, and in particular highly deformed parts, by combining an optimised chemical composition and particular methods of manufacture, making it possible to avoid as much as possible solution heat treatment on the shaped sheet.

In the article "Al—(4.5-6.3)Cu—1.3Li—0.4Ag-0.4Mg—0.14Zr Alloy Weldalite 049" from Pickens, J R; Heubaum, F H; Langan, T J; Kramer, L S published in Aluminum—Lithium Alloys. Vol. III; Williamsburg, Va.; USA; 27-31 Mar. 1989. (Mar. 27, 1989), various heat treatments are described for these high copper content alloys.

In order for these alloys to be selected in aircraft, their performance with respect to the other commercial properties must attain that of commonly used alloys, in particular in terms of the compromise between the properties of static mechanical resistance (limit of elasticity, resistance to rupture) and the properties of tolerance to damage (tenacity, resistance to the propagation of cracks in fatigue), with these products being contradictory in general. The improvement of the compromise between the mechanical resistance and the tolerance to damage is constantly sought. Moreover their resistance to corrosion must be sufficient whether in the final temper used or in the intermediary tempers during the manufacturing schedule.

Another important property of thin sheets made of Al—Cu—Li alloy, in particular those of which the thickness is between 0.5 and 10 mm, is the ability to be shaped. These sheets are in particular used to manufacture aircraft fuselage elements or rocket elements which have a general complex 3-dimensional shape. In order to reduce the manufacturing cost, aircraft manufacturers seek to minimise the number of steps for shaping sheets, and to use sheets that can be manufactured inexpensively using short transformation procedures, i.e. comprising as few individual steps as possible.

For the manufacture of fuselage panels, several methods are known. For low deformations during shaping, typically less than 4%, it is possible to procure sheets in a mature quenched temper (temper "T3" little strain-hardened or "T4"), and to shape the sheets in this temper.

However, in most cases, the deformation sought is substantial, locally of at least 5% or 6%. A current practice of aircraft manufacturers then consists in general in procuring hot or cold rolled sheets according to the required thickness, in the raw temper of manufacture (temper "F" according to the standard EN 515) in a mature quenched temper ("T3" or "T4" temper), even in an annealed temper ("O" temper), in subjecting them to a heat treatment of solution annealing followed by quenching, then in shaping them on cold quenching ("W" temper), before finally subjecting them to natural or artificial ageing, in such a way as to obtain the required mechanical characteristics.

In another practice, a sheet is used in a O temper, or even in a T3, T4 temper or in the F temper, a first operation is carried out of shaping from this temper, and a second shaping after solution heat treatment and quenching. This alternative is in particular used when the desired shaping is too substantial to be carried out in single operation from a W temper, but can however be carried out in two passes starting from a O temper. In addition, sheets in the O temper are stable over time and are easier to transform. However, manufacturing the sheet in the O temper requires a final annealing of the raw rolled sheet, and therefore generally an additional step of manufacturing, and also a solution heat treatment and quenching on the shaped product which is contrary to the goal of simplification aimed by this invention.

The shaping of elements of complex structure in the T8 temper is limited to cases of shaping that are not very substantial because the elongation and the $R_m/R_{p02}$ ratio are too low in this temper.

Note that the optimum properties in terms of a compromise in properties have to be obtained once the part has been shaped, in particular as a fuselage element, since it is the shaped part that in particular has to have good performance in tolerance to damage in order to avoid excessively frequent repair of fuselage elements. It is generally admitted that the strong deformations after solution heat treatment and quenching lead to an increase in the mechanical resistance but to a sharp degradation in tenacity.

Moreover, the sheets that are delivered to the aircraft manufacturer can be stored for a period of time that is sometimes significant before being shaped and being subjected to aging. It is therefore suitable to prevent these sheets from being sensitive to corrosion in such a way in particular to simplify the storage conditions.

There is a need for a simplified method of manufacture that allows for the shaping of rolled products made of aluminium-copper-lithium alloy in order to obtain in particular fuselage elements economically, while still obtaining satisfactory mechanical characteristics, with the products having before shaping a high resistance to corrosion.

SUMMARY

A first objet of the invention is a method of manufacturing a rolled product with an aluminium alloy base in particular for the aeronautics industry wherein, successively a) a bath of liquid metal with an aluminium base is elaborated comprising 2.1 to 3.9% by weight of Cu, 0.6 to 2.0% by weight of Li, 0.1 to 1.0% by weight of Mg, 0 to 0.6% by weight of Ag, 0 to 1% by weight of Zn, at most 0.20% by weight of the sum of Fe and of Si, at least one element from among Zr, Mn, Cr, Sc, Hf and Ti, the quantity of said element, if it is chosen, being 0.05 to 0.18% by weight for Zr, 0.1 to 0.6% by weight for Mn, 0.05 to 0.3% by weight for Cr, 0.02 to 0.2% by weight for Sc, 0.05 to 0.5% by weight for Hf and from 0.01 to 0.15% by weight for Ti, the other elements at most 0.05% by weight each and 0.15% by weight in total, the rest aluminium;

b) a rolling ingot is cast using said bath of liquid metal;

c) optionally, said rolling ingot is homogenised;

d) said rolling ingot is hot rolled and optionally cold rolled into a sheet with a thickness between 0.5 and 10 mm, e) said sheet is solution heat treated and quenched;

f) optionally said sheet is levelled and/or stretched in a controlled manner with a cumulative deformation of at least 0.5% and less than 3%, g) a short heat treatment is carried out wherein said sheet reaches a temperature between 145° C. and 175° C. and preferably between 150° C. and 170° C. for 0.1 to 45 minutes and preferably for 0.5 to 5 minutes, the speed of heating being between 3 and 600° C./min.

Another object of the invention is a rolled product able to be obtained by the method according to the invention having a limit of elasticity $R_{p0.2}(L)$ and/or $R_{p0.2}(LT)$ between 75% and 90%, preferentially between 80 and 85% and preferably between 81% and 84% of the limit of elasticity in the same direction of a sheet of the same composition in the T4 or T3 temper having been subjected to the same controlled stretching after quenching, at least one property chosen from among a $R_m/R_{p0.2}(L)$ ratio of at least 1.40 and preferably at least 1.45 and a $R_m/R_{p0.2}$ (LT) ratio at least 1.45 and preferably at least 1.50 and has at least one corrosion resistance property chosen from among a grade according to the standard ASTM G34 for sheets subjected to the conditions of the test ASTM G85 A2 of P and/or EA and an intergranular corrosion that is little developed for sheets subjected to the conditions of the standard ASTM G110.

Yet another object of the invention is the use of a product obtained by a method according to the invention for the manufacture of a structure element for an aircraft, in particular for an aircraft fuselage skin.

DETAILED DESCRIPTION OF A PREFERRED EMBODIMENT

Figure 1:
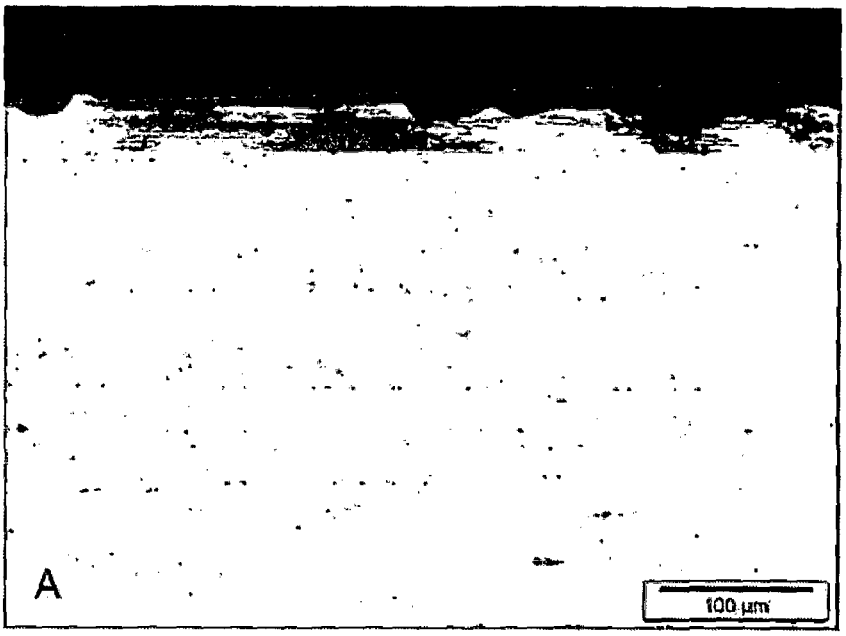
FIG. 1: Micrographic section of the sample S after exposure in the conditions ASTM G110.

Unless mentioned otherwise, all of the indications concerning the chemical composition of the alloys are expressed as a percentage by weight based on the total weight of the alloy. The expression 1.4 Cu means that the content of copper expressed as a % by weight is multiplied by 1.4. The designation of the alloys is done is accordance with the regulations of The Aluminium Association, known to those skilled in the art. The definitions of the metallurgical tempers are indicated in European standard EN 515.

The static mechanical characteristics in traction, in other terms the resistance to rupture $R_m$, the conventional limit of elasticity at 0.2% of elongation $R_{p0.2}$, and the ultimate elongation A %, are determined by a traction test according to the standard NF EN ISO 6892-1, the sampling and the direction of the test being defined by the standard EN 485-1. The tests for resistance to corrosion are carried out according to the standards ASTM G34, ASTM G85 A2 and ASTM G110.

According to the invention, after rolling in the form of a sheet, solution heat treatment, quenching and possible levelling and/or stretching at least one short heat treatment is carried out with a duration and a temperature such that the sheet reaches a temperature between 145° C. and 175° C. and preferably between 150° C. and 170° C. for 0.1 to 45 minutes, advantageously from 0.2 to 20 minutes, more preferably for 0.5 to 5 minutes and even more preferably for 1 to 3 minutes, the speed of heating being between 3 and 600° C./min. The short heat treatment is advantageously carried out after a natural aging of at least 24 hours after quenching and preferably at least 48 hours after quenching. Indeed, it is advantageous that aging takes place with appearance of hardening precipitates so that the short heat treatment has the desired effect. Typically, following the short heat treatment, the limit of elasticity $R_{p0.2}$ is significantly lower, i.e. by at least 20 MPa or even by at least 40 MPa in the directions L and LT, with respect to that of the same sheet in a T3 or T4 temper. The short heat treatment is not a aging with which a T8 temper would be obtained but a particular heat treatment which makes it possible to obtain a non-standardised temper that is particularly able to be shaped. Indeed, a sheet in the T8 temper has a limit of elasticity greater than that of the same sheet in a T3 or T4 temper while after the short heat treatment according to the invention the limit of elasticity is on the contrary lower than that of a T3 or T4 temper. Advantageously, the short heat treatment is carried out in such a way as to obtain an equivalent time at 150° C. from 0.5 to 35 minutes, preferably from 1 to 20 minutes and more preferably from 2 to 10 minutes, the equivalent time $t_i$ at 150° C. is defined by the formula:

$$t_i = \frac{\int \exp(-16400/T)dt}{\exp(-16400/T_{ref})}$$

where T (in Kelvin) is the instantaneous treatment temperature of the metal, which changes with the time t (in minutes), and $T_{ref}$ is a reference temperature set to 423 K, $t_i$ is expressed in minutes, the constant Q/R=16400 K is derived from the activation energy for the diffusion of the Cu, for which the value Q=136100 J/mol was used.

Surprisingly, the inventors observed that the mechanical properties obtained at the end of the short heat treatment are stable over time, which makes it possible to use the sheets in the temper obtained at the end of the short heat treatment instead of a sheet in a O temper or in a W temper for shaping. In addition the inventors observed that surprisingly, the high speed of heating during the short heat treatment and/or a low duration of the short heat treatment make it possible to obtain an improved capacity for shaping while still maintaining a resistance to corrosion of the sheet at the end of the short heat treatment, in particular to intergranular and exfoliating corrosion, equivalent to that of a sheet in the T3 or T4 temper.

Preferably, for the short heat treatment, the speed of heating is between 10 and 400° C./min and preferentially between 40 and 300° C./min. The speed of heating is typically the average slope of the temperature of the sheet according to time for the heating between the ambient temperature and 145° C.

For sheets with a thickness less than 6 mm the speed of heating is preferentially at least 80° C./min.

In such a way as to limit the equivalent time at 150° C., it is also preferable to cool sufficiently quickly the sheets after the short treatment. Advantageously, during the short heat treatment the speed of cooling is between 1 and 1000° C./min, preferentially between 10 and 800° C./min. The speed of cooling is typically the average slope of the temperature of the sheet according to time for the cooling between 145° C. and 70° C. or even between 145° C. and 30° C. In an embodiment of the invention the cooling is carried out by aspersion of a liquid such as for example water or by immersion in such a liquid. In another embodiment of the invention, the cooling is carried out with air with optionally a forced convection, with the cooling speed then being more preferably between 1 and 400° C./min, preferentially between 40 and 200° C./min.

Advantageously the short heat treatment is carried out in a continuous furnace. Typically, a continuous furnace is a furnace such that the sheet is supplied in the form of a coil which is continuously unwound in order to be treated thermally in the furnace then cooled and wound.

The inventors observed that surprisingly, not only the short heat treatment makes it possible to simplify the method of manufacture of the products by suppressing the shaping on the O or W temper, but in addition the compromise between static mechanical resistance and tolerance to damage in artificially aged temper is at least identical or even improved thanks to the method of the invention, with respect to a method that does not comprise a short heat treatment. In particular for an additional cold deformation of at least 5% after short heat treatment, the compromise obtained between static mechanical resistance and tenacity is improved with respect to prior art.

The advantage of the method according to the invention is obtained for products that have a content in copper between 2.1 and 3.9% by weight. In an advantageous embodiment of the invention, the content in copper is at least 2.8% or 3% by weight. A maximum content of 3.7 or 3.4% by weight is preferred.

The content in lithium is between 0.6% or 0.7% and 2.0% by weight. Advantageously, the content in lithium is at least 0.70% by weight. A maximum content in lithium of 1.4 or even 1.1% by weight is preferred.

The content in magnesium is between 0.1% and 1.0% by weight. Preferentially, the content in magnesium is at least 0.2% or even 0.25% by weight. In an embodiment of the invention the maximum content in magnesium is 0.6% by weight.

The content in silver is between 0% and 0.6% by weight. In an advantageous embodiment of the invention, the content in silver is between 0.1 and 0.5% by weight and preferably between 0.15 and 0.4% by weight. The addition of silver contributes in improving the compromise of the mechanical properties of the products obtained by the method according to the invention.

The content in zinc is between 0% and 1% by weight. Preferably, the content in zinc is less than 0.6% by weight, preferably less than 0.40% by weight. Zinc is generally an undesirable impurity, in particular due to its contribution to the density of the alloy, in an embodiment of the invention the content in zinc is less than 0.2% by weight and preferably less than 0.04% by weight. However in another embodiment zinc can be used alone or in combination with silver, a minimum content in zinc of 0.2% by weight is then advantageous.

The alloy also contains at least one element that can contribute to the control of the size of grain chosen from among Zr, Mn, Cr, Sc, Hf and Ti, with the quantity of the element, if it is chosen, being from 0.05 to 0.18% by weight for Zr, 0.1 to 0.6% by weight for Mn, 0.05 to 0.3% by weight for Cr, 0.02 to 0.2% by weight for Sc, 0.05 to 0.5% by weight for Hf and from 0.01 to 0.15% by weight for Ti. Preferably it is chosen to add between 0.08 and 0.15% by weight of zirconium and between 0.01 and 0.10% by weight of titanium and the content in Mn, Cr, Sc and Hf is limited to a maximum of 0.05% by weight, as these elements can have an unfavourable effect, in particular on the density and being added solely to further favour the obtaining of a substantially non-recrystallised structure if necessary.

In an advantageous embodiment of the invention, the content in zirconium is at least equal to 0.11% by weight.

In another embodiment of the invention, the content in manganese is between 0.2 and 0.4% by weight and the content in zirconium is less than 0.04% by weight.

The sum of the content in iron and of the content in silicon is at most 0.20% by weight. Preferably, the contents in iron and in silicon are each at most 0.08% by weight. In an advantageous embodiment of the invention the contents in iron and in silicon are at most 0.06% and 0.04% by weight, respectively. A controlled and limited content in iron and in silicon contributes to improving the compromise between mechanical resistance and tolerance to damage.

The other elements have a content at most 0.05% by weight each and 0.15% by weight in total, these are unavoidable impurities, the rest is aluminium.

The method of manufacture according to the invention comprises the steps of elaborating, casting, rolling, solution heat treating, quenching, optionally levelling and/or stretching and short heat treatment.

In a first step, a liquid metal bath is elaborated in such a way as to obtain an aluminium alloy with a composition according to the invention.

The liquid metal bath is then cast in the form of a rolling ingot.

The rolling ingot can then be optionally homogenised in such a way as to reach a temperature between 450° C. and 550° and preferably between 480° C. and 530° C. for a duration between 5 and 60 hours. The homogenisation treatment can be carried out in one or several steps.

The rolling ingot is then hot rolled then optionally cold rolled into a sheet. The thickness of said sheet is between 0.5 and 10 mm, advantageously between 0.8 and 8 mm and preferably between 1 and 6 mm.

The product obtained as such is then typically solution heat treated by a heat treatment that makes it possible to reach a temperature between 490 and 530° C. for 5 min to 8 h, then quenched typically with water at ambient temperature or preferably with cold water.

Optionally, said solution heat treated and quenched sheet can be levelled and/or stretched in a controlled manner with a cumulative deformation of at least 0.5% and less than 3%. When a levelling is carried out, the deformation carried out during levelling is not always known precisely but it is estimated to be approximately 0.5%. When it is carried out, the controlled stretching is implemented with a permanent deformation between 0.5 to 2.5% and more preferably between 0.5 to 1.5%. However in an embodiment of the invention the short heat treatment is carried out directly after quenching without intermediate strain-hardening, but advantageously after a natural aging of at least 24 hours. This embodiment without intermediate strain-hardening is advantageous in particular when the steps of solution heat treatment, quenching and short heat treatment are carried out continuously in a continuous furnace. Moreover the inventors observed that in the absence of intermediate strain-hardening between quenching and short heat treatment of defects such as the Lüders lines that appear after shaping that could be suppressed in certain cases.

The product then undergoes a short heat treatment already described.

At the end of the short heat treatment, the sheet obtained with the method according to the invention advantageously has, typically for at least 50 days and even for at least 200 days, after short heat treatment, a limit of elasticity $R_{p0.2}(L)$ and/or $Rp_{0.2}(LT)$ between 75% and 90%, preferentially between 80 and 85% and preferably between 81% and 84% of the limit of elasticity in the same direction of a sheet of the same composition in the T4 or T3 temper having been subjected to the same controlled stretching after quenching, at least one property chosen from among a $R_m/R_{p0.2}$ (L) ratio of at least 1.40 and preferably at least 1.45 and a $R_m/R_{p0.2}$ (LT) ratio at least 1.45 and preferably at least 1.50 and has at least one corrosion resistance property chosen from among a grade according to the standard ASTM G34 for sheets subjected to the conditions of the test ASTM G85 A2 of P and/or EA and an intergranular corrosion that is little developed for sheets subjected to the conditions of the standard ASTM G110.

In an advantageous embodiment, at the end of the short heat treatment, the sheet obtained by the method according to the invention typically has for at least 50 days and even for at least 200 days after short heat treatment, a combination of at least one property chosen from among $R_{p0.2}(L)$ of at least 220 MPa and preferably of at least 250 MPa, $Rp_{0.2}(LT)$ of at least 200 MPa and preferably of at least 230 MPa, $R_m(L)$ of at least 340 MPa and preferably of at least 380 MPa, $R_m(LT)$ of at least 320 MPa and preferably of at least 360 MPa with a property chosen among A % (L) at least 14% and preferably at least 15%, A % (LT) at least 24% and preferably at least 26%, $R_m/R_{p0.2}$ (L) at least 1.40 and preferably at least 1.45, $R_m/R_{p0.2}$ (LT) at least 1.45 and preferably at least 1.50 and has at least one corrosion resistance property chosen from among a grade according to the standard ASTM G34 for sheets subjected to the conditions of the test ASTM G85 A2 of P and/or EA and an intergranular corrosion that is little developed for sheets subjected to the conditions of the standard ASTM G110.

In an advantageous embodiment of the invention at the end of the short heat treatment, the sheet obtained by the method according to the invention has a $R_m/R_{p0.2}$ ratio in the direction LT of at least 1.52 or 1.53.

Advantageously, for at least 50 days and preferably for at least 200 days after the short heat treatment, the sheet obtained by the method according to the method has a limit of elasticity $R_{p0.2}(L)$ less than 290 MPa and preferably less than 280 MPa and $R_{p0.2}(LT)$ less than 270 MPa and/or a resistance to rupture $R_m(L)$ less than 410 MPa and preferably less than 400 MPa and $R_{p0.2}(LT)$ less than 390 MPa.

Advantageously the grade according to the standard ASTM G34 for sheets subjected to the conditions of the test ASTM G85 A2 is P or P-EA.

Figure 2:
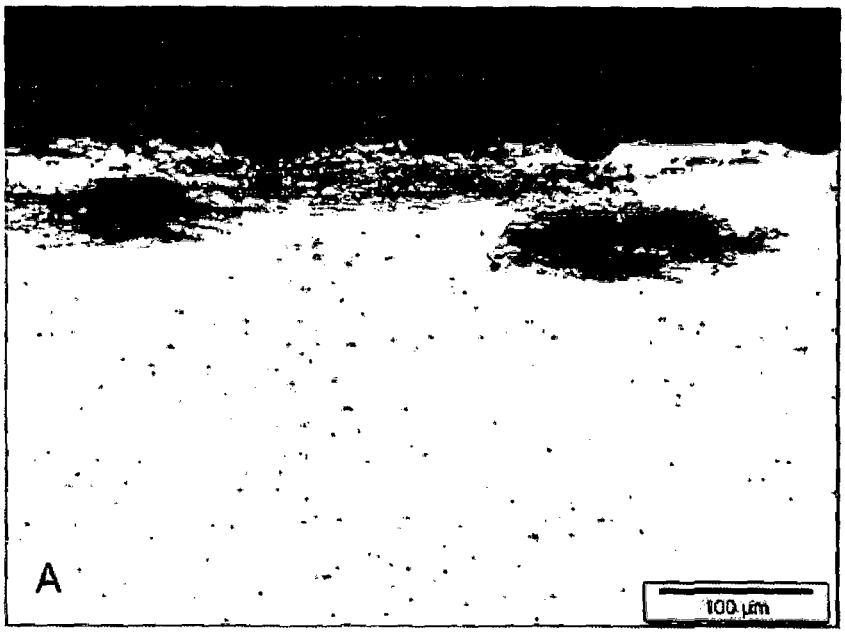
FIG. 2: Micrographic section of the sample H2 after exposure in the conditions ASTM G110.

In the scope of the invention it is considered that the intergranular corrosion for sheets subjected to the conditions of the standard ASTM G110 is little developed if it corresponds to the images of FIG. 1 or 2. Advantageously, the sheet obtained by the method according to the invention has a resistance to intercrystalline corrosion at least equal to that of a sheet of the same composition in the T3 or T4 temper.

At the end of the short heat treatment, the sheet can be stored without any particular difficulties thanks to its resistance to intercrystalline corrosion. The sheet after the short heat treatment is ready for additional cold deformation, in particular an operation of shaping in three dimensions. An advantage of the invention is that this additional deformation can reach, locally or in a generalised manner, values from 6 to 8% or even up to 10%. In order to attain sufficient mechanical properties at the end of the aging in the T8 temper, a minimum cumulative deformation of 2% between said additional deformation and the cumulative deformation by levelling and/or controlled stretching optionally carried out before the short heat treatment is advantageous. Preferably, the additional cold deformation is locally or in a generalised manner of at least 1% more preferably at least 4% and even more preferably at least 6%.

An artificial aging is finally carried out wherein said sheet shaped as such reaches a temperature between 130 and 170° C., advantageously between 145 and 165° C. and preferably between 150 and 160° C. for 5 to 100 hours and preferably from 10 to 70 h. The aging can be carried out in one or several stages.

Advantageously the cold deformation is carried out by one or several methods for shaping such as stretching, stretching-shaping, stamping, flow turning or folding. In an advantageous embodiment, this is a shaping in three dimensions of the space in order to obtain a part with a complex shape, more preferably via stretching-shaping.

As such the product obtained at the end of the short heat treatment can be shaped like a product in an O temper or a product in a W temper. However, with respect to a product in an O temper it has the advantage of no longer requiring a solution heat treatment and quenching in order to reach the final mechanical properties, with a simple aging treatment being sufficient. With respect to a product in a W temper, it has the advantage of being stable and of not requiring a cold room and to not give rise to problems linked to the deformation of this temper. The product also has the advantage in general of not generating and redhibitory Lüders lines during the shaping. As such the short heat treatment can for example be carried out at the manufacturer of the sheet, be stored without any particular precautions thanks to its high resistance to intergranular corrosion and carried out the shaping at the manufacturer of the aeronautical structure, directly on the product delivered. The method according to the method makes it possible to carry out the shaping in 3 dimensions of a sheet at the end of the short heat treatment without the sheet being in a T8 temper, a O temper or a W temper before this shaping in 3 dimensions.

Surprisingly, the compromise between the static mechanical properties and the properties of tolerance to damage obtained at the end of the artificial aging is advantageous with respect to that obtained for a similar treatment that does not comprise a short heat treatment.

Using a product able to be obtained by the method according to the method comprising the steps of short heat treatment, cold deformation and artificial aging for the manufacture of a structure element for aircraft, in particular a fuselage skin is particularly advantageous.

Example

In this example, conditions of short heat treatment were compared for a sheet made of AA2198 alloy with a thickness of 4.3 mm. A rolling ingot made of alloy AA2198 of which the composition is provided in Table 1 was homogenised then hot rolled until a thickness of 4.3 mm. The sheets obtained as such were solution heat treated 30 min at 505° C. then quenched with water.

TABLE 1

Composition of the sheet made of AA2198 alloy used, as a % by weight.

| Si | Fe | Cu | Mn | Mg | Zr | Li | Ag | Ti | Zn |
|---|---|---|---|---|---|---|---|---|---|
| 0.03 | 0.05 | 3.3 | 0.05 | 0.34 | 0.14 | 0.99 | 0.28 | 0.03 | 0.03 |

The sheets were then stretched in a controlled manner. The controlled stretching was carried out with a permanent elongation of 2%. The natural aging was of at least 24 hours after quenching.

The sheets were then subjected to a short heat treatment of which the conditions are given in Table 2. The highest speeds of heating, representing heating speeds obtained in a continuous furnace, were obtained by immersion in an oil bath while the lowest heating speeds were obtained by treatment with controlled air, representing the industrial conditions in a static furnace. The speed of cooling was approximately 60° C./min for all of the tests.

TABLE 2

Conditions for short heat treatment

| Invention or Reference | Sample | Heating speed (° C./min) | Maintained duration (min) | Maintained temperature (° C.) | Equivalent time at 150° C. (min) |
|---|---|---|---|---|---|
| Reference | S | — | — | — | — |
| Invention | H1 | 100 | 1 | 150 | 1.3 |
| Invention | H2 | 100 | 2 | 150 | 2.3 |
| Invention | H4 | 100 | 4 | 150 | 4.3 |
| Invention | H8 | 100 | 8 | 150 | 8.3 |
| Invention | H16 | 100 | 16 | 150 | 16.3 |
| Invention | H30 | 100 | 30 | 150 | 30.3 |
| Reference | A30 | 0.33 | 30 | 150 | 61.8 |
| Reference | A60 | 0.33 | 60 | 150 | 91.8 |
| Reference | A120 | 0.33 | 120 | 150 | 151.8 |
| Reference | A240 | 0.33 | 240 | 150 | 271.8 |

The static mechanical properties after short heat treatment were characterised in the longitudinal (L) and transverse (LT) directions and are presented in Table 3.

TABLE 3

Static mechanical properties in MPa ($R_{p0.2}$ and $R_m$) or as a % (A %)

| Sample | $R_{p0.2}$(L) | $R_m$(L) | A %(L) | $R_{p0.2}$(LT) | $R_m$(LT) | A %(LT) |
|---|---|---|---|---|---|---|
| S | 322 | 438 | 13.4 | 288 | 408 | 23.2 |
| H1 | 274 | 394 | 14.4 | 246 | 373 | 24.2 |
| H2 | 271 | 393 | 14.0 | 246 | 373 | 26.0 |
| H4 | 261 | 384 | 13.2 | 238 | 366 | 26.9 |
| H8 | 260 | 382 | 13.8 | 236 | 365 | 25.4 |
| H16 | 259 | 383 | 13.8 | 234 | 365 | 25.5 |
| H30 | 257 | 384 | 13.5 | 233 | 364 | 27.1 |
| A30 | 262 | 387 | 14.2 | 239 | 370 | 27.1 |
| A60 | 261 | 391 | 14.9 | 237 | 368 | 26.4 |
| A120 | 265 | 391 | 15.2 | 240 | 369 | 27.3 |
| A240 | 285 | 403 | 16.5 | 254 | 375 | 27.4 |

The corrosion resistance properties of the sheets were evaluated in the conditions of normalised tests of intergranular corrosion (ASTM G110) and exfoliating corrosion (MASTMAASIS dry bottom ASTM G85-A2). The immersion test duration of the ASTM G110 test is 6 h and the test duration of the MASTMAASIS test is 750 h. The characterisations were carried out on the surface ("skin") and after machining of a tenth of the thickness ("T/10").

The results of the intergranular corrosion tests according to ASTM G110 are shown in Table 4.

Figure 3:
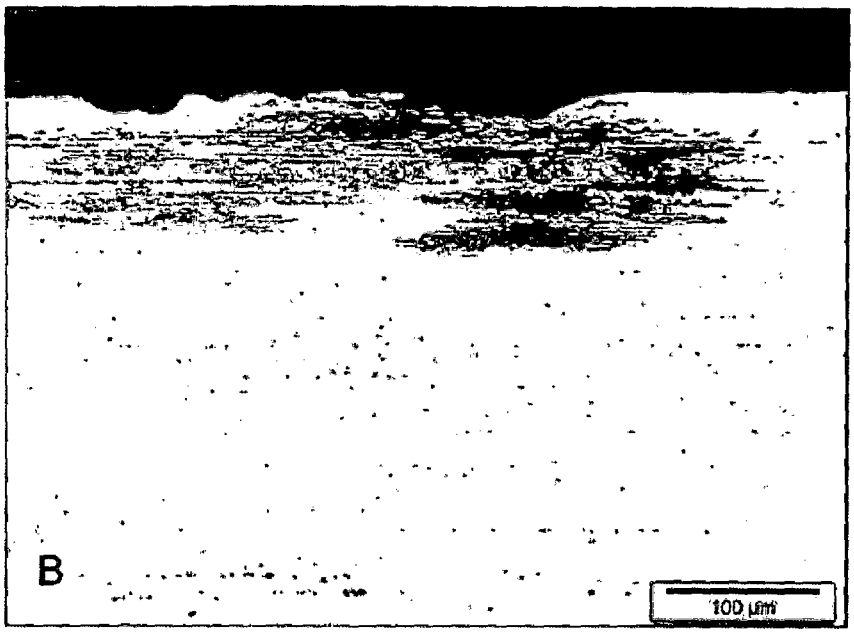
FIG. 3: Micrographic section of the sample A30 after exposure in the conditions ASTM G110.
Figure 4:
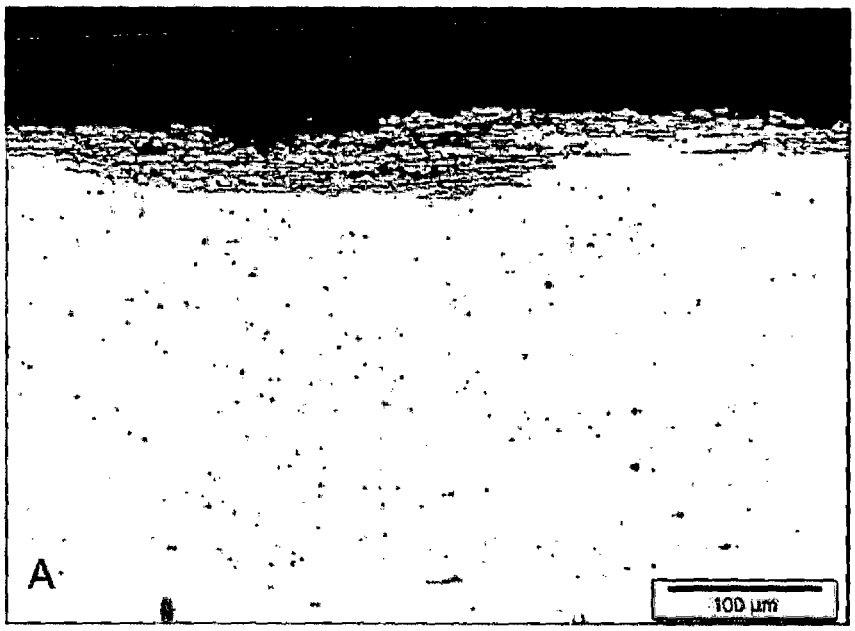
FIG. 4: Micrographic section of the sample A120 after exposure in the conditions ASTM G110.

The micrographic cross-sections that are representative of an intergranular corrosion that is little developed and pits are given in FIGS. 1 (sample S) and 2 (sample H2). The observations were made using an optical microscope with a magnification of ×200. A micrographic cross-section that are representative of a developed intergranular corrosion and pits is given in FIG. 3 (sample A30). A micrographic cross-section that represents a developed intergranular corrosion is given in FIG. 4 (sample A120).

TABLE 4 results of the intergranular corrosion tests according to ASTM G110

| Sample | Surface tested: Skin | Surface tested: T/10 |
|---|---|---|
| S | I.C. little developed + pitting | I.C. little developed + pitting |
| H1 | I.C. little developed + pitting | I.C. little developed + pitting |
| H2 | I.C. little developed + pitting | I.C. little developed + pitting |
| H4 | I.C. little developed + pitting | I.C. little developed + pitting |
| H8 | I.C. little developed + pitting | I.C. little developed + pitting |
| H16 | I.C. little developed + pitting | I.C. little developed + pitting |
| H30 | I.C. little developed + pitting | I.C. little developed + pitting |
| A30 | Developed I.C. + pitting | Developed I.C. + pitting |
| A60 | Developed I.C. | Developed I.C. |
| A120 | Developed I.C. | Developed I.C. |
| A240 | Developed I.C. | Developed I.C. |

I.C.: intergranular corrosion

The results of the exfoliating corrosion tests according to the standard ASTM G34 for sheets subjected to the conditions of the MASTMAASIS test (dry bottom ASTM G85-A2) are shown in Table 5.

TABLE 5

Exfoliating corrosion test results in the conditions of the MASTMAASIS test (dry bottom ASTM G85-A2).

| Sample | Surface tested: Skin | Surface tested: T/10 |
|---|---|---|
| S | P | P |
| H1 | P-EA | P-EA |
| H2 | P-EA | P-EA |
| H4 | P-EA | P-EA |
| H8 | P-EA | P-EA |
| H16 | P-EA | P-EA |
| H30 | EA | EA |
| A30 | EB-EC | EB-EC |
| A60 | EC | EB-EC |
| A120 | EC | EC |
| A240 | EC | EC |

The sample S is a sample in the T3 temper. It does not have any mechanical properties that make it possible to consider it shaping for the highest deformations. The samples A30, A60, A120, A240 have mechanical properties that make it possible to consider the shaping for the highest deformations but have a resistance to corrosion that requires particular precautions during storage.

The samples H1, H2, H4, H8, H16 and H30 simultaneously have mechanical properties that make it possible to consider its shaping for the highest deformations and a resistance to corrosion that make it possible to consider a storage without particular precautions. The sample H1 however has mechanical properties that are a little less favourable, in particular in terms of elongation in the direction LT. The sample H30 has properties that are a little less favourable, in particular in terms of resistance to corrosion.

The invention claimed is:

1. A method for manufacturing a rolled product with an aluminium alloy base comprising in order:

a) a bath of liquid metal with an aluminium base is obtained comprising 2.1 to 3.9% by weight of Cu, 0.6 to 2.0% by weight of Li, 0.1 to 1.0% by weight of Mg, 0 to 0.6% by weight of Ag, 0 to 1% by weight of Zn, at most 0.20% by weight of the sum of Fe and of Si, at least one element from among Zr, Mn, Cr, Sc, Hf and Ti, the quantity of said element, if it is chosen, being 0.05 to 0.18% by weight for Zr, 0.1 to 0.6% by weight for Mn, 0.05 to 0.3% by weight for Cr, 0.02 to 0.2% by weight for Sc, 0.05 to 0.5% by weight for Hf and from 0.01 to 0.15% by weight for Ti, the other elements at most 0.05% by weight each and 0.15% by weight in total, the rest aluminium;

b) a rolling ingot is cast using said bath of liquid metal;

c) optionally, said rolling ingot is homogenised;

d) said rolling ingot is hot rolled and optionally cold rolled into a sheet of a thickness between 0.5 and 10 mm, e) said sheet is solution heat treated and quenched;

f) optionally said sheet is levelled and/or stretched in a controlled manner with a cumulative deformation of at least 0.5% and less than 3%, g) carrying out a short heat treatment by heating said sheet at a speed between 3 and 600° C./min., wherein said sheet reaches a temperature between 145° C. and 175° C. for 0.1 to 45 minutes.

2. The method according to claim 1 wherein said short heat treatment is carried out in such a way as to obtain an equivalent time at 150° C. of 0.5 to 35 minutes, the equivalent time $t_i$ at 150° C. is defined by the formula:

$$t_i = \frac{\int \exp(-16400/T)dt}{\exp(-16400/T_{ref})}$$

where T (in Kelvin) is the instantaneous treatment temperature of the metal, which changes with the time t (in minutes), and $T_{ref}$ is a reference temperature set to 423 K, $t_i$ is expressed in minutes, the constant Q/R=16400 K is derived from the activation energy for the diffusion of the Cu, for which the value Q=136100 J/mol is used.

3. The method according to claim 1 wherein, during the step g of short heat treatment, a speed of cooling is between 1 and 1000° C./min.

4. The method according to claim 1 wherein said short heat treatment is carried out directly after quenching without intermediate strain-hardening.

5. The method according to claim 1 wherein a content in copper is at least 2.8% and at most 3.4% by weight.

6. The method according to claim 1 wherein a content in lithium is at least 0.70% by weight and at most 1.1% by weight.

7. The method according to claim 1 wherein a content in magnesium is at least 0.2% and at most 0.6% by weight.

8. The method according to claim 1 wherein the alloy contains between 0.08 and 0.15% by weight of zirconium, between 0.01 and 0.10% by weight of titanium and wherein the content in Mn, Cr, Sc and Hf is at most 0.05% by weight.

9. The method according to claim 1 wherein after the step g, h) an additional cold deformation is carried out on said sheet in such a way that the additional deformation is less than 10%, i) an artificial aging is carried out wherein said sheet reaches a temperature between 130 and 170° C. for 5 to 100 hours.

10. The method according to claim 1, wherein in (g), said sheet reaches a temperature between 150° C. and 170° C. for 0.5 to 5 minutes, the speed being between 3 and 600° C./min.

11. The method according to claim 1, wherein in (g), said sheet reaches a temperature between 150° C. and 170° C. for 1 to 3 minutes, the speed being between 3 and 600° C./min.

12. The method according to claim 1, wherein in (f), said sheet is levelled and/or stretched in a controlled manner with a cumulative deformation of at least 0.5% and less than 3%.

13. The method according to claim 1, wherein said rolled product comprises a limit of elasticity $R_{p0.2}$(L) and/or $R_{p0.2}$(LT) from 75% to 90% of the limit of elasticity in the same direction of a sheet of the same composition in the T4 or T3 temper having been subjected to the same controlled stretching after quenching; and at least one property selected from the group consisting of a $R_m/R_{p0.2}$(L) ratio of at least 1.40 and a $R_m/R_{p0.2}$(LT) ratio at least 1.45.

14. The method of claim 1, wherein said rolled product comprises at least one corrosion resistance property selected from the group consisting of a grade according to the standard ASTM G34 for sheets subjected to the conditions of the test ASTM G85 A2 of P and EA and an intergranular corrosion that is little developed for sheets subjected to the conditions of the standard ASTM G110.

15. The method according to claim 1, wherein said rolled product comprises at least one property selected from the group consisting of:

$R_{p0.2}$(L) of at least 220 MPa;

$R_{p0.2}$(LT) of at least 200 MPa;

$R_m$(L) of at least 340 MPa;

$R_m$(LT) of at least 320 MPa;

A % (L) at least 14%; and

A % (LT) at least 24%.

16. The method according to claim 2, wherein said short heat treatment is carried out in such a way as to obtain an equivalent time at 150° C. of from 1 to 20 minutes.

17. The method according to claim 9, wherein in (i), the artificial aging is carried out wherein said sheet reaches a temperature between 145 and 165° C. for 10 to 70 h.

* * * * *